US005143262A

United States Patent [19]

Edlund

[11] Patent Number: 5,143,262

[45] Date of Patent: Sep. 1, 1992

[54] RECESSED SOAP DISPENSER

[76] Inventor: Gregory D. Edlund, 160 SW. 12th Ave., Suite 101-C, Deerfield Beach, Fla. 33442

[21] Appl. No.: 708,779

[22] Filed: May 21, 1991

[51] Int. Cl.[5] ..... B67D 5/06; B67D 5/38; B67D 5/52; B67D 5/64

[52] U.S. Cl. ..... 222/129; 222/135; 222/156; 222/164; 222/181; 222/183

[58] Field of Search ..... 222/180, 173, 181, 183, 222/129, 135, 160, 164, 156

[56] References Cited

U.S. PATENT DOCUMENTS

| | | | |
|---|---|---|---|
| 626,085 | 5/1899 | Ormerod | 222/181 X |
| 1,032,861 | 7/1912 | Powell | 222/181 X |
| 2,965,427 | 12/1960 | Sessions | 222/181 X |
| 3,008,609 | 11/1961 | Sessions | 222/181 X |
| 3,187,954 | 6/1965 | Hammer et al. | 222/183 X |
| 4,548,340 | 10/1985 | Messer | 222/181 X |

*Primary Examiner*—Kevin P. Shaver
*Attorney, Agent, or Firm*—Malin, Haley, McHale, Dimaggio & Crosby

[57] ABSTRACT

An apparatus for dispensing shower products such as liquid or granular soaps, shampoos, and the like, fabricated as a unitary housing which is constructed and configured for flush mounting against the surface of a wall panel. The apparatus generally comprises a rectangular shaped housing which is defined by an upper face, two side faces, and a partially sloped rear face which is recessed within the wall panel. A receptacle having one or more integral storage compartments is disposed within, and hingedly connected to, said housing, said receptacle may contain one or more known dispensing mechanisms for providing a supply of dispensing materials, and may further comprise external indication means for conveying the status of the supply of said dispensing materials which may be replenished by rotating said receptacle outward from the wall panel.

11 Claims, 4 Drawing Sheets

RECESSED SOAP DISPENSER

BACKGROUND OF THE INVENTION

1. Field of the Invention

This invention relates to soap dispensers generally and, in particular, relates to a viscous liquid or granular soap dispenser containing one or more soap receptacle compartments and dispensing means, recessed within and flush with the mounting surface so as not to occupy unnecessary and valuable workspace.

2. Background

Many soap dispensing devices are available of the type which may be mounted on the wall of a bathroom, lavatory, kitchen or laundry which dispense small premeasured amounts of liquid or granular soap, or the like, stored therein. Virtually all such dispensers are mounted to the room facing wall surface, protruding into the workspace and occupying precious room.

For example, in most household showers, there is very little room to move about as necessary. The addition of a protruding, wall-mounted dispensing apparatus reduces the available space apreciably and creates an unwanted and potentially dangerous obstruction.

It would therefore be most beneficial to provide a soap dispensing apparatus which is recessed within and flush with a mounting surface such as a shower wall. Therefore, it is a principal object of the present invention to provide a recessed soap dispenser for liquid or granular soap, shampoo and the like which mounts flush with a wall surface which may be installed by simply removing a number of tiles in an existing wall or installed in new construction which is economical to manufacture, efficient in operation, and particularly well adapted for the proposed usage thereof.

SUMMARY OF THE INVENTION

Described herein is a device for dispensing liquid or granular soaps, shampoos and the like constructed of a one piece housing, preferably of PVC material, which is constructed and arranged for flush mounting against the surface of a wall panel. The device is comprised generally of a rectangular shaped housing connectable to the wall having a sloped lower rear corner to assist in cleaning and water run-off. Said housing is further provided with pivot members to which are hingedly connected one or more dispensing receptacles. Said receptacles are disposed within said housing and provided with any known dispensing mechanism and may be swung forward about said pivot members for refilling. The receptacles may be transparent or provided with an aperture to provide a visual signal of the level of the soap therewithin.

The receptacle or receptacles may be covered with tile to match the surrounding tile or other material compatable with the surrounding wall surface to render the dispenser partially concealed. The bottom of the receptacles and bottom surface of the housing define a recessed opening into which one may reach to dispense the quantity of soap desired by activating the dispensing mechanism.

The invention will be better understood in view of the drawings and detailed disclosure which follows.

DETAILED DESCRIPTION OF THE PREFERRED EMBODIMENT

Figure 1:
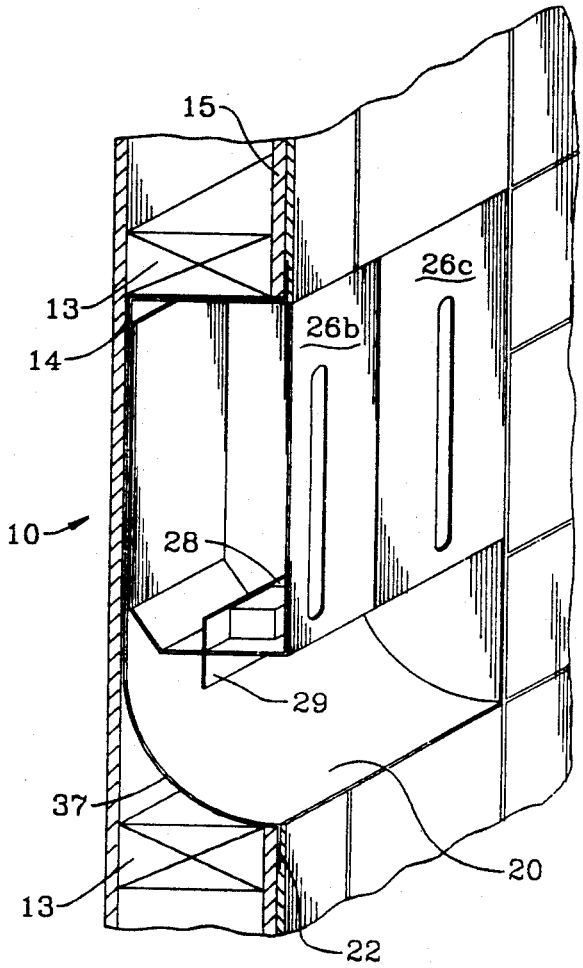
FIG. 1 is a perspective partial cut-away view showing the invention installed flush within a wall.
Figure 2:
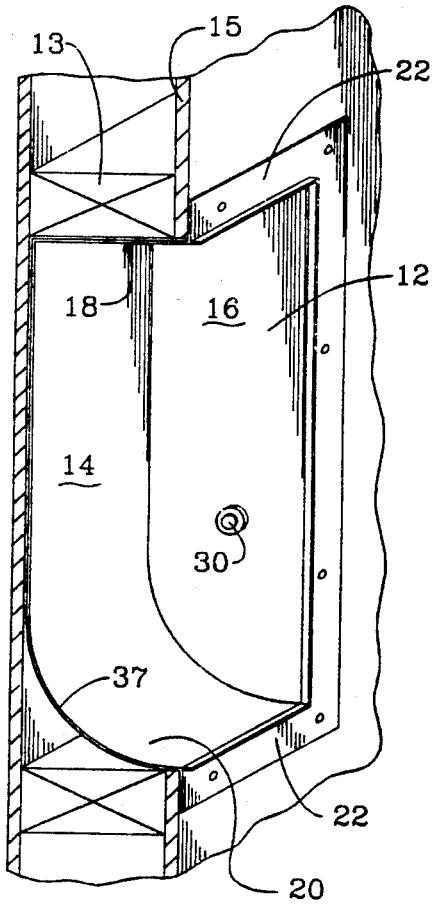
FIG. 2 is a perspective view of the illustration of FIG. 1 with the soap receptacles removed.
Figure 3:
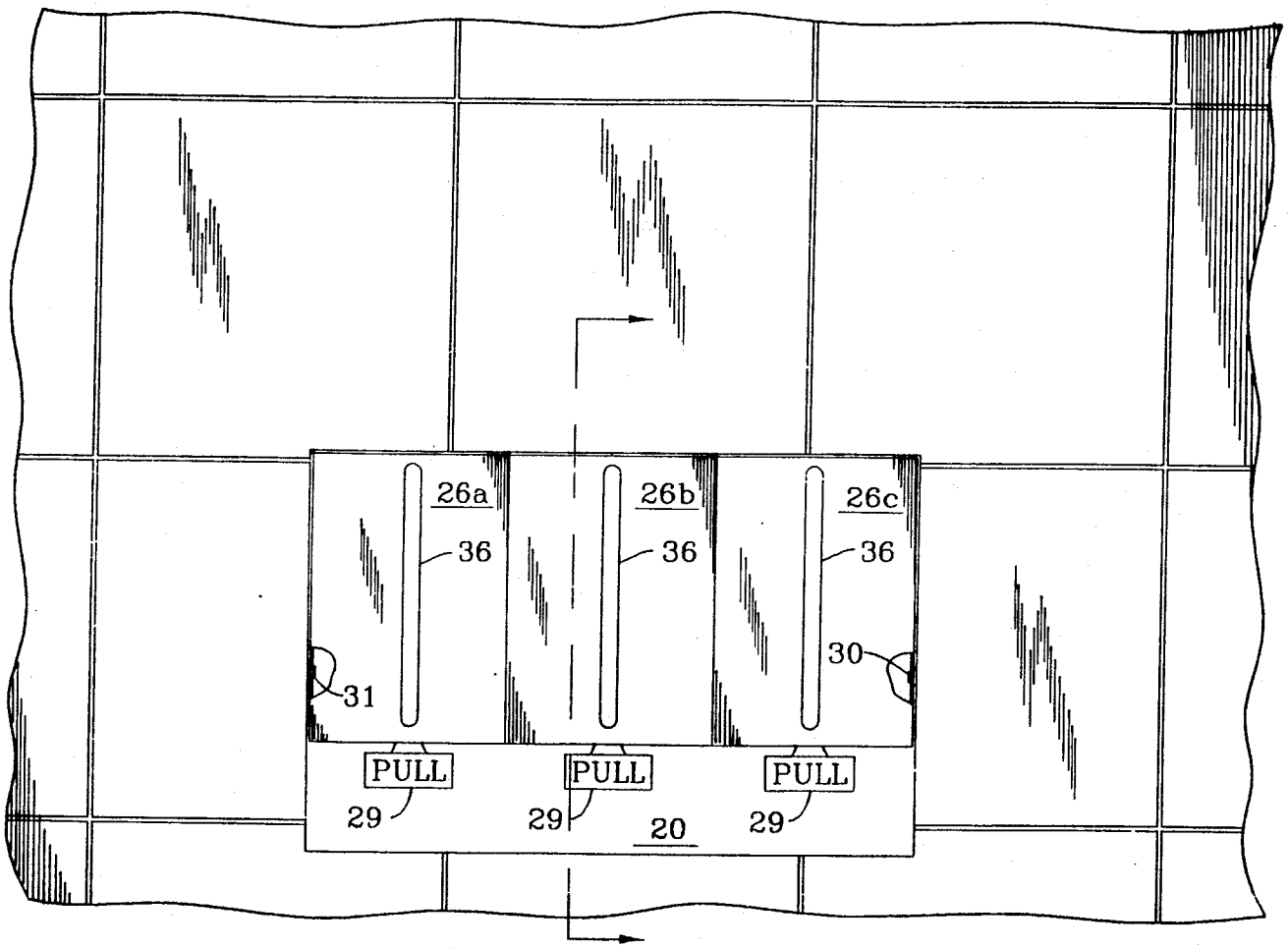
FIG. 3 is a front elevational view of the first embodiment of the invention.

Referring now to the drawings, FIGS. 1 through 3 show the recessed dispenser 10 which is comprised of a generally rectangular one piece housing member 12 comprised of a rear wall 14, opposed spaced side walls 16, upper wall 18 and lower sloped wall 20. Walls 16, 18 and 20 are bordered at the front by mounting flange 22 which may be provided with apertures for use of connecting means such as nails to attach housing 12 to an existing or new wall 15. Horizontal wall studs 13 may be employed to provide additional installed strength to the dispensing unit.

A soap holding receptacle 26 is hingedly mounted to the housing 12 via male hinge members 30 which are connected to side walls 16 positioned to mate with corresponding aligned female hinge members 31 disposed within the side walls of said receptacle 26. Receptacle 26 may be divided into a plurality of compartments such as 26(*a*), (*b*) and (*c*) for storing and dispensing a variety of soaps such as shampoo, liquid soap and conditioner, or, alternatively, laundry detergent, bleach and fabric softener. Each compartment is provided with its own dispensing means 28 which, in the preferred embodiment, is comprised of a pull handle 29 pivotally connected to any known dispensing apparatus 28.

Indication means such as elongated windows 36 may be provided in each receptacle compartment to permit the viewing of the level of soap within each compartment. Alternatively, receptacle 26 may be constructed of a transparent material.

Bottom wall 20, which is preferably gently curving to facilitate the runoff of water and soap, together with receptacle 26 and the lower portions of side walls 16, forms a recessed opening into which the user may reach his or her hand to pull on lever 29 and dispense the desired quantity of soap. Said recessed opening may be made substantially larger so that a user may place a hand-held receptacle such as a measuring cup (not shown) thereunder to dispense soap thereinto.

Figure 6:
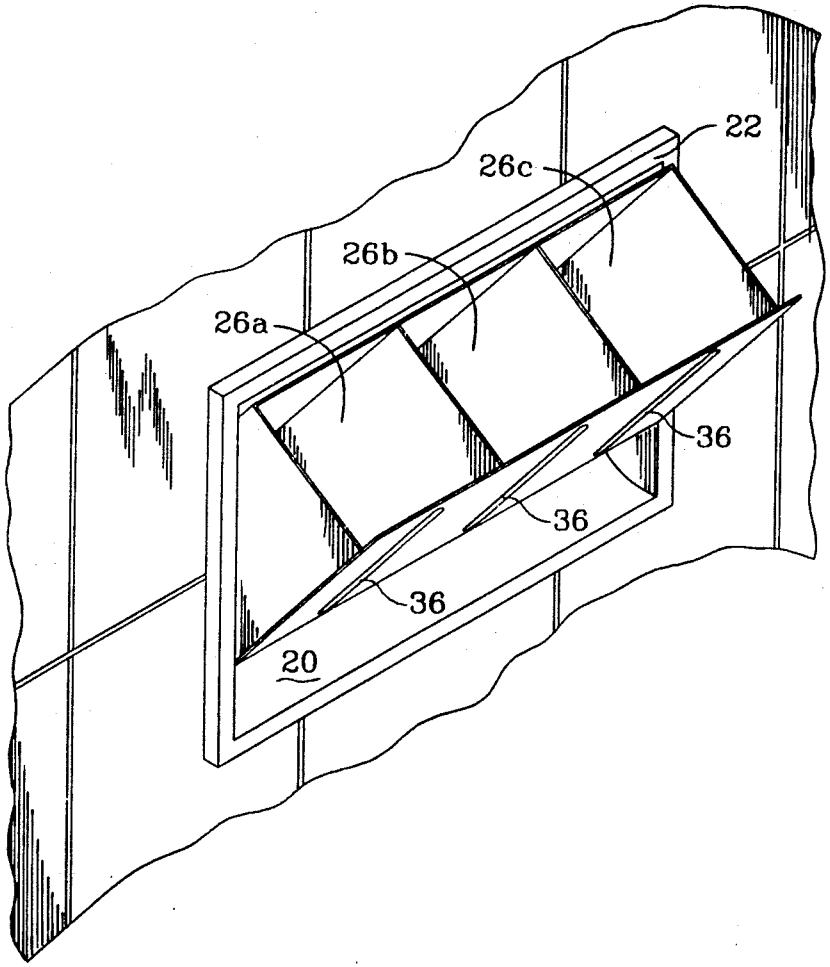
FIG. 6 is an assembled view of the drawings of FIG. 5.
Figure 4:
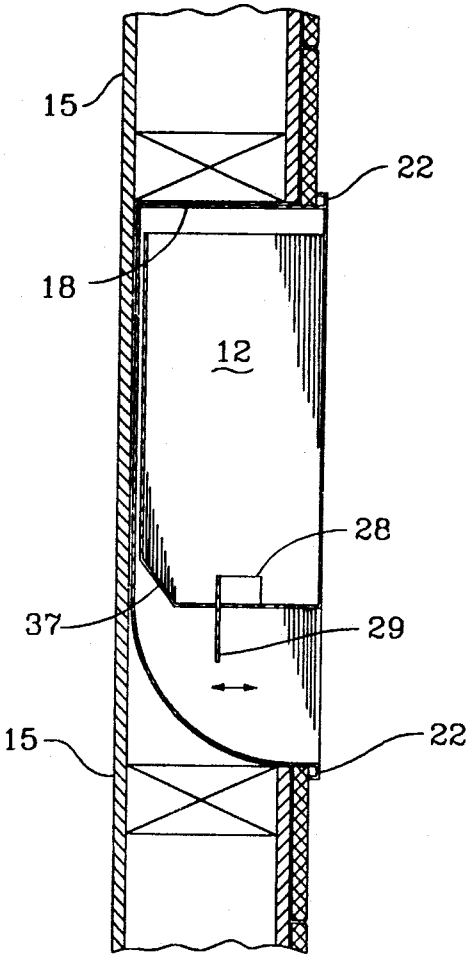
FIG. 4 is a cross-sectional view of the second embodiment of the invention taken along lines 4—4 of FIG. 3.
Figure 5:
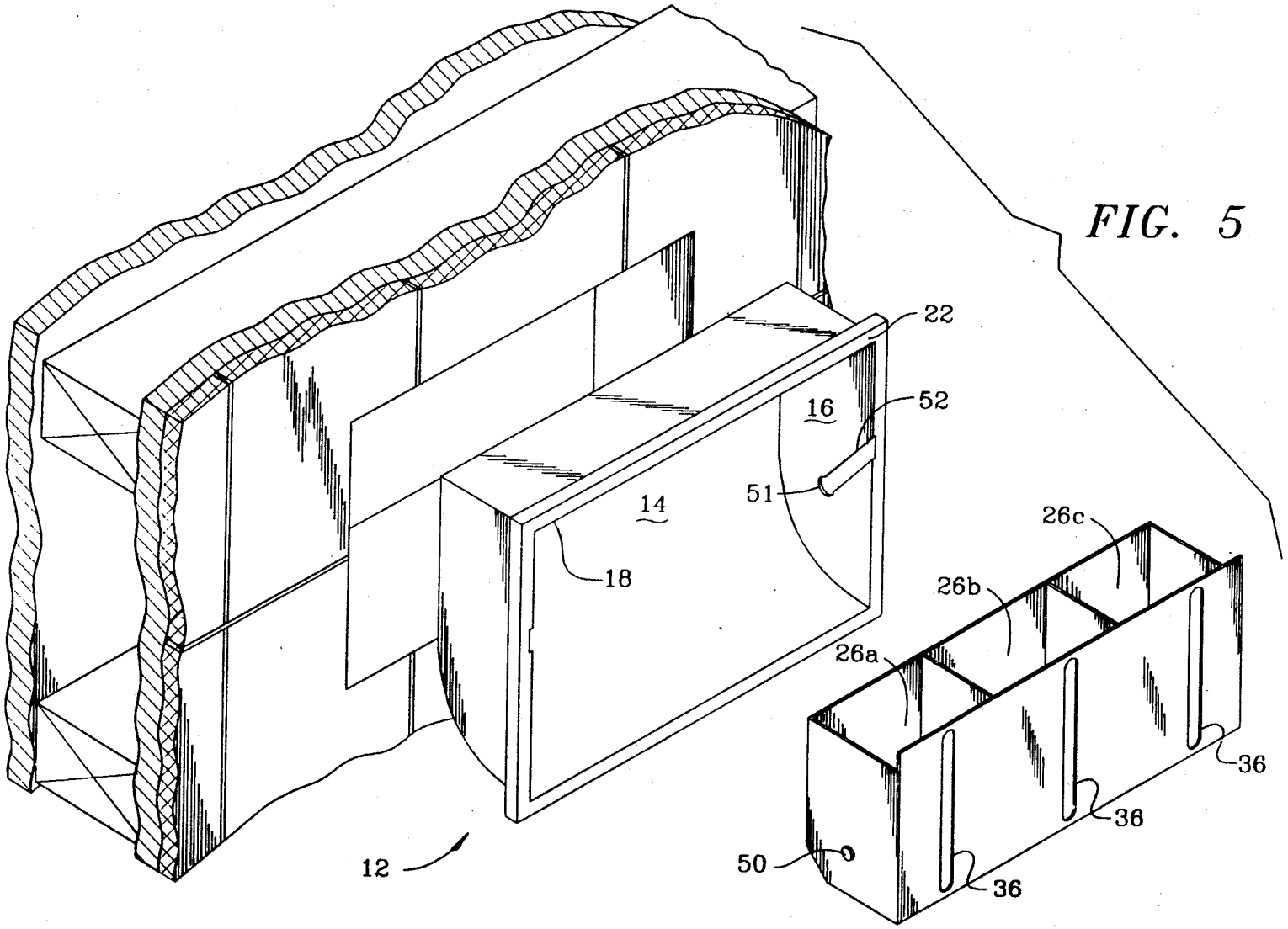
FIG. 5 is an exploded perspective view of the second embodiment of the instant invention.

FIGS. 4 through 6 show a second embodiment of the instant invention wherein housing 12 is provided with a peripheral mounting flange 22' specifically suitable for installation of dispensing system 10 in an existing tile or other wall. Mounting flange 22' serves the purpose of providing a secure abutment with wall 15 and/or tile members T and also covers the edge of the opening made in the existing wall or tile to enable the installation of the dispensing system 10.

FIG. 4 shows the invention installed in an existing wall wherein receptacle 26 is rotatable about hinge members 50, 51, 31 so that the top end of receptacle 26 may be rotated outwardly exposing compartments 26(*a*) through 26(*c*) for refilling as is the case for the embodiment of FIGS. 1 through 3. Depending upon the geometry of the dispensing system 10, receptacle 26 should be provided with angled wall 37 so that the rear of receptacle 26 clears rear wall 14 of housing 12 when said receptacle is tipped outwardly during the refilling operation.

FIG. 5 shows an exploded view of the second embodiment showing the hinge means wherein the male hinge member 50 is connected to receptacle 26 on either side thereof and housing 12 provided with corresponding aligned female hinge members 51. Further provided are track ways 52 in side walls 16 to permit the slideable entry of male hinge members 50 during the installation of receptacle member 26 into housing 12. Thereafter, male hinge members 50 are permitted to freely pivot in female hinge members 51 when it is desired to refill a receptacle compartment.

FIG. 6 shows the apparatus of the second embodiment in assembled form wherein receptacle member 26 is tipped out for refilling of the compartments 26*a–c*.

It can therefore be seen that the instant invention provides a novel apparatus for installing soap dispensing receptacles within the confines of an existing or new wall in a space which would otherwise go unused, to substantially reduce or eliminate the valuable workspace otherwise occupied by prior art soap dispensers.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A soap dispenser containing a dispensing apparatus, said soap dispenser adapted to be recessed within a bathroom wall, comprising:

a rectangular main housing defined by a pair of opposing side walls, an upper wall, and a partially sloped rear wall; and a secondary housing rotatably mounted within said main housing, said secondary housing defined by a front wall, a rear wall, a chamfered base wall, and a pair of opposing side walls, thereby forming a storage chamber having an open top end, said secondary housing being rotatably mounted in said main housing from a first closed position with said secondary housing rear wall abutting said main housing rear wall, to a second open position thereby facilitating access to said storage chamber, and dispensing means for actuating said dispensing apparatus disposed within said storage chamber, said dispensing means rigidly attached to said secondary housing.

2. The soap dispenser recited in claim 1, wherein said secondary housing further comprises a plurality of intermediate vertical walls disposed parallel to said secondary housing side walls, and perpendicular to said secondary housing front and rear walls respectively, thereby forming a plurality of storage chambers having a common open top end.

3. The soap dispenser recited in claim 1, wherein said secondary housing front wall further comprises indication means for external observation of dispensing materials disposed within said chamber.

4. The soap dispenser recited in claim 3, wherein said indication means is comprised of elongated apertures defined by said secondary housing front wall.

5. The soap dispenser recited in claim 1, further comprising a peripheral mounting flange which circumscribes, and is rigidly attached to, said main housing side walls, top wall, and partially sloped rear wall respectively.

6. The soap dispenser recited in claim 1, further comprising hinge means for facilitation of said rotatable mounting between said main and secondary housings respectively.

7. The soap dispenser recited in claim 6, wherein said hinge means comprises a pair of male hinge members rigidly secured to said main housing side walls, and a pair of female hinge members rigidly attached to said secondary housing side walls, and disposed within said male hinge members.

8. The soap dispenser recited in claim 6, wherein said hinge means comprises a pair of male hinge members rigidly secured to said secondary housing side walls, a pair of female hinge members rigidly attached to said main housing side walls, and a pair of recessed tracks defined in said main housing side walls to facilitate the installation of said secondary housing into said main housing.

9. A soap dispenser containing a dispensing apparatus adapted to be recessed within a bathroom wall, comprising:

a rectangular main housing defined by a pair of opposing side walls, an upper wall, and a partially sloped rear wall, said main housing further comprising a peripheral mounting flange which circumscribes, and is rigidly attached to, said main housing side walls, top wall, and partially sloped rear wall, respectively;

a secondary housing rotatably mounted within said main housing, said secondary housing defined by a front wall, a rear wall, a chamfered base wall, a pair of opposing side walls, and a plurality of intermediate vertical walls disposed parallel to said secondary housing side walls, and perpendicular to said secondary housing front and rear walls respectively, thereby forming a plurality of storage chambers having a common open top end, said secondary housing front wall comprising indication means for external observation of dispensing materials disposed within said plurality of storage chambers, wherein said indication means is comprised of said elongated apertures defined by secondary housing front wall, said rotatable attachment between said secondary and main housing comprises hinge means rigidly secured to said secondary and main housing respectively, whereby said secondary housing may be rotated from a first closed position with said secondary housing rear wall generally parallel to main housing rear wall, to a second open position thereby facilitating access to said storage chambers; and dispensing means for actuating said dispensing apparatus disposed within said storage chambers, said dispensing means rigidly attached to said secondary housing.

10. The soap dispenser recited in claim 9, wherein said hinge means comprises a pair of male hinge members rigidly secured to said main housing side walls, and a pair of female hinge members rigidly attached to said secondary housing side walls, and disposed within said male hinge members.

11. The soap dispenser recited in claim 9, wherein said hinge means comprises a pair of male hinge members rigidly secured to said secondary housing side walls, a pair of female hinge members rigidly attached to said main housing side walls, and a pair of slotted tracks defined in said main housing side walls to facilitate the installation of said secondary housing into said main housing.

* * * * *